United States Patent [19]

Billi

[11] 3,945,224

[45] Mar. 23, 1976

[54] CONTROL SYSTEM FOR CIRCULAR KNITTING MACHINES AND THE LIKE

[75] Inventor: Giorgio Billi, Florence, Italy

[73] Assignee: Billi, S.p.A., Florence, Italy

[22] Filed: July 30, 1973

[21] Appl. No.: 383,480

[52] U.S. Cl. ..... 66/56; 66/155

[51] Int. Cl.[2] D04B 9/00; D04B 15/99; D04B 15/16

[58] Field of Search ..... 66/155, 56

[56] References Cited

UNITED STATES PATENTS

| | | | |
|---|---|---|---|
| 2,736,178 | 2/1956 | Lawson | 66/56 |
| 2,817,220 | 12/1957 | Mahler et al. | 66/56 |
| 2,970,461 | 2/1961 | Hoffman | 66/155 |
| 3,232,079 | 2/1966 | Levine et al. | 66/155 UX |
| 3,776,003 | 12/1973 | Krause | 66/155 X |

FOREIGN PATENTS OR APPLICATIONS

| | | | |
|---|---|---|---|
| 1,000,029 | 8/1965 | United Kingdom | 66/155 |

*Primary Examiner*—Wm. Carter Reynolds
*Attorney, Agent, or Firm*—Clifton T. Hunt, Jr.

[57] ABSTRACT

Rotations of a circular knitting machine are counted and encoded into electrical signals. After a prescribed number of revolutions a programmer and program indicating disc signal a switching mechanism to shift a cam drum to the next position in the pattern. A first circuit is provided for operating the needle cylinder at a slower speed during the aforesaid shifting operation, and a second circuit is provided for running the machine at maximum and intermediate speeds during the knitting operation in response to a preselected pattern. The programmer includes two types of output signals for controlling the production of fabric according to type or size.

14 Claims, 9 Drawing Figures

Fig. 8
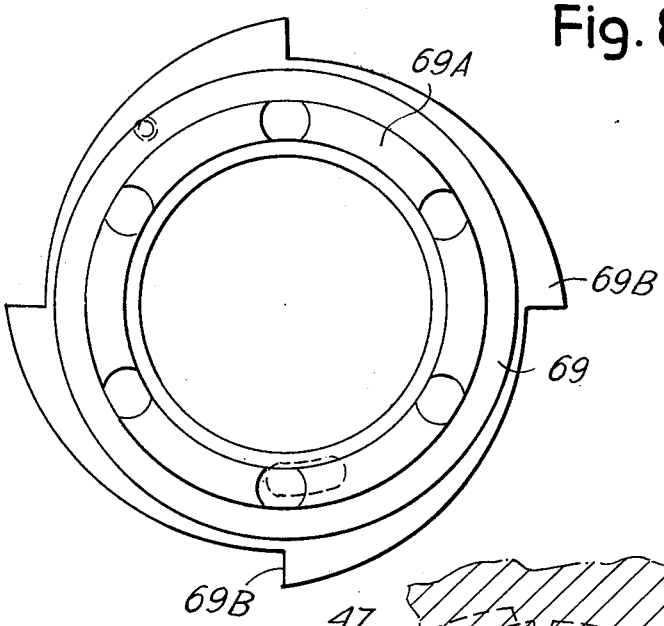
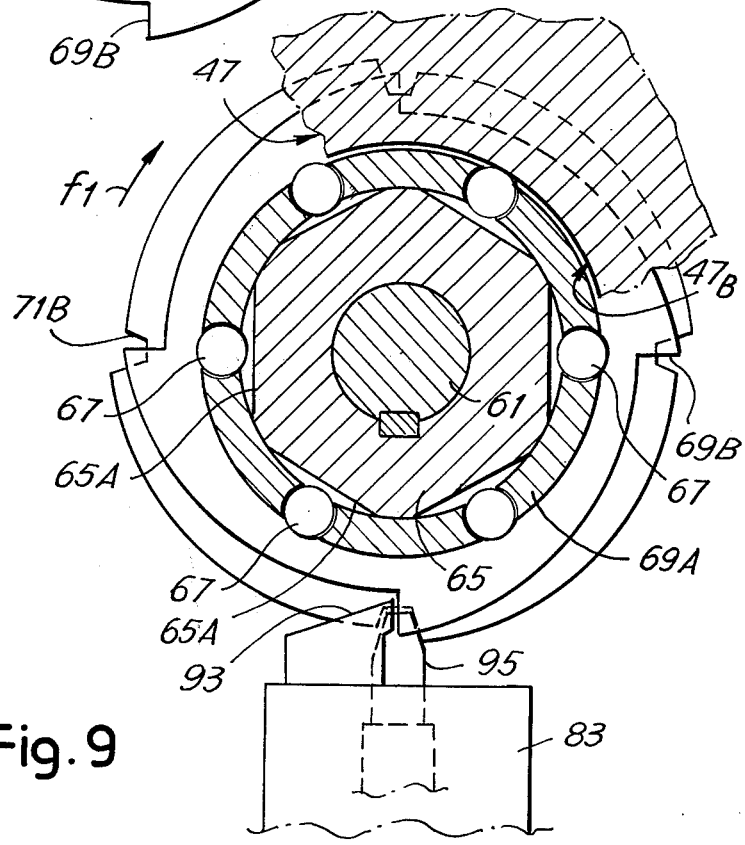
Fig. 9

CONTROL SYSTEM FOR CIRCULAR KNITTING MACHINES AND THE LIKE

SUMMARY OF THE INVENTION

The present invention is directed to an electronic and electromechanical control apparatus for use with various types of machines, but especially designed to replace the mechanical chain programming in circular stocking machines and the like. The apparatus includes a needle cylinder, a program cam drum and controls to modify the cylinder speed between a minimum speed and at least one faster speed. The equipment may be also used for other applications where a pre-established program capable of modification, must be cyclically repeated, in machine tools, operating machines in general and the like.

The purpose of the present equipment is to simplify the programming unit, to facilitate programming modification, and to provide a cheaper and smaller system.

The invention includes basically a counter of the needle cylinder revolutions combined with a zero setting means therefore; a programming unit which receives pulses from the revolution counter and which is selectively programmed by means of removable and/or changeable contacts; a cam drum position indicating means including a brush member rotatable with respect to a fixed disc member and cooperating therewith by means of contacts on said disc in the form of conductive arcuate segments corresponding in position to the discreet advances of the cam drum to determine signals as a function of the instantaneous drum position and corresponding in length to the duration of the desired subsequent movements thereof, on corresponding output lines; an assembly of coincidence circuits, fed by signals from the programming unit and by signals from the output lines from the aforesaid cam drum position indicating means, said coincidence circuits transmitting an output signal after a programmed number of revolutions scheduled for each cam drum stopping position have occurred, so as to initiate the advance of the cam drum and brush member by means of a motion take-up apparatus connected to the cylinder and/or with a step-step motor or another suitable means, and advantageously with an irreversible type drive.

The assembly of the coincidence circuits includes a plurality of NAND gate circuits with some inputs connected to contacts controlled by the program disc and other inputs connected to the programming unit outputs; the outputs of said gates being re-united to supply signals both to a control group or unit for advancing the cam drum, to the zero setting means, and to a cylinder speed varying device.

In a preferred embodiment, a decoding means is connected to the revolution counter of the binary output type. The programming unit includes, as removable or changeable contacts, both pin contacts and rotary switch contacts. The removable pin contacts are utilized to modify the type of article to the produced, while the more easily operable rotary switches are utilized to modify the dimensions, that is, the programmed article size.

The system may include a cylinder speed control unit with an electronic means for inducing minimum speed control and a locking gate means for inducing higher speed control wherein the cylinder speed during drum advance and the consequent control of the minimum speed take place. The minimum speed control advantageously involves a signal logic inverter which preferably operates by the annulling of a voltage.

Some machines include means to drive the cylinder with at least two speeds higher than the minimum one. In such cases the system according to the invention should include two locking AND gate means for control of said two higher speeds, each designed to receive both the coincidence circuit signal and the voltage signal coming from certain contacts of the fixed disc to preset one of two higher speeds for a selected disc contact whereby selected positions of the drum unlock or release the control of an intermediate speed, and other positions of the drum release or unlock the control of a maximum speed. In either case both controls are locked during the cam drum advance state.

For controlling the cam drum advance, a bistable switch is provided which generates a control signal when it receives either a signal, especially double and reversed by the presence of a logic switch, from the coincidence circuits, or also when it receives a synchronization pulse derived from the signals supplied by the needle cylinder to the counter. The zero setting means is designed to supply a stop signal of the drum advance responsive to the passage of an interruption between two contacts on the program disc. The inertia of the counter members, of the programming unit, of the coincidence circuits and above all of the bistable switch is such that the synchronizing pulse which determines the control signal to advance the drum is subsequent to the pulse which is received as an output signal from the coincidence circuits to reduce to the minimum speed. In this way one obtains the speed reduction of the cylinder before the cam drum advances.

The brush member rotates integrally with the cam drum and includes a double brush or another bridge-like grazing or wiping contact. The fixed disc member includes a first continuous annular metal track having a voltage imparted thereto and second segmented annular metal track concentric with the first and having output wires attached thereto. The double brush or other bridge-like wiping contact is designed to form a bridge or jumper to selectively connect the endless track with one segment of the segmented track. Alternatively the segments could operate micro-switches or reed contacts or switches of the inductive, capacitive, magnetic, photo-electric, pneumatic, piezoelectric type or the like.

The system according to the invention may thus replace the conventional program chain of a circular stocking machine or hosiery machine. This system, which may be called an "electronic chain", has the fundamental function of advancing or stopping the cam drum of a circular stocking machine. In the machine of the present invention, a complete rotation of the cam drum corresponds to the manufacture of a complete stocking or another article of a given type. The drum however does not make its complete revolution with a continuous motion, but effects partial revolutions with more or less long pauses, therebetween. The needle cylinder, on the contrary, is always rotating, both at the moment when the cam drum is rotating, and while the cam drum is stopped. The conventional program, on the other hand, always advances counting the cylinder revolutions, but without operating a control on the cams drum until "neutral loops or stitches" are present. When the high loops move beneath a feeler, a control is activated.

The operation of the electronic chain is somewhat similar, attaining however both a substantial structural simplicity (in comparison with the conventional system) and also a quicker possibility of program transformation (both for the article "type" and the "size", that is the dimensions of the article of the same type). The electronic chain, thus, counts the cylinder revolutions during drum stoppages, and when the electronic counter reaches a pre-established number of rotations for that portion of the operational cycle, it delivers the advance control to the drum while keeping the electronic data stored during the time the drum accomplishes the partial rotation. The duration of this drum rotation (and thus its angular advance) is tied in to the extent of the advance and operated thereby. In particular, the angular advance of the drum may be adjusted by the conductive segments of the disc which is fixed with respect to the machine. When these brushes, which are advancing with the cam drum, contact a portion of insulating material between two adjacent segments, a signal is delivered to the electronic unit to cease the drum motion (as that determined angular movement required has terminated) and also a signal is delivered to the same counter to re-begin the count of the cylinder revolutions which must be effected before the next subsequent drum movement. Once the selected number of rotations of the next cycle is reached, the counter again delivers the advance signal to the drum, which then stops at the end of the movement prescribed for that point of the cycle. The operation continues for the whole operational cycle.

The invention will be better understood following the description and the accompanying drawing, which illustrates a preferred embodiment but is not to be construed as constrictly the scope of the same invention. In the drawing.

Figure 5:
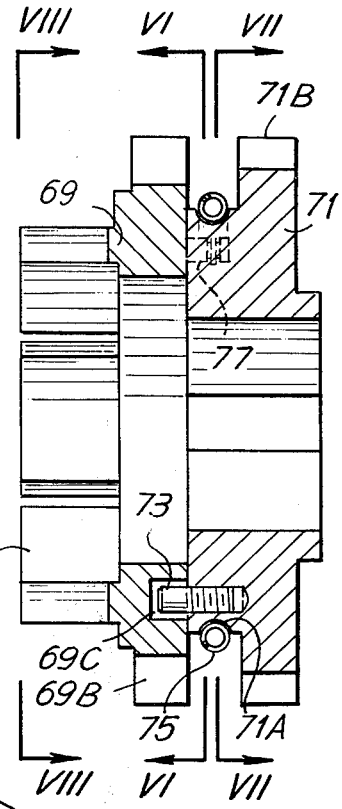
FIG. 5 illustrates an enlarged detail of internal members shown in FIG. 4.
Figure 7:
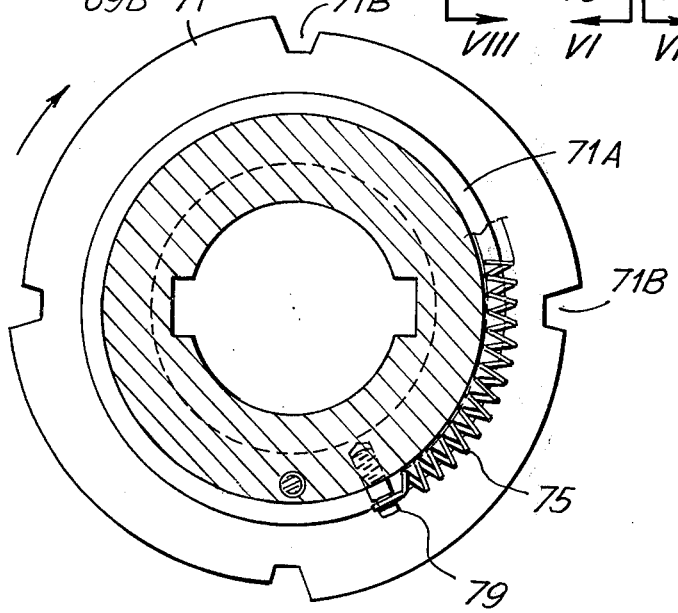

FIGS. 6, 7, 8 and 9 illustrate views and cross-sections taken along the lines VI—VI; VII—VII; VIII—VIII of FIG. 5, and explanatory cross-section of the coupling.

Figure 1:
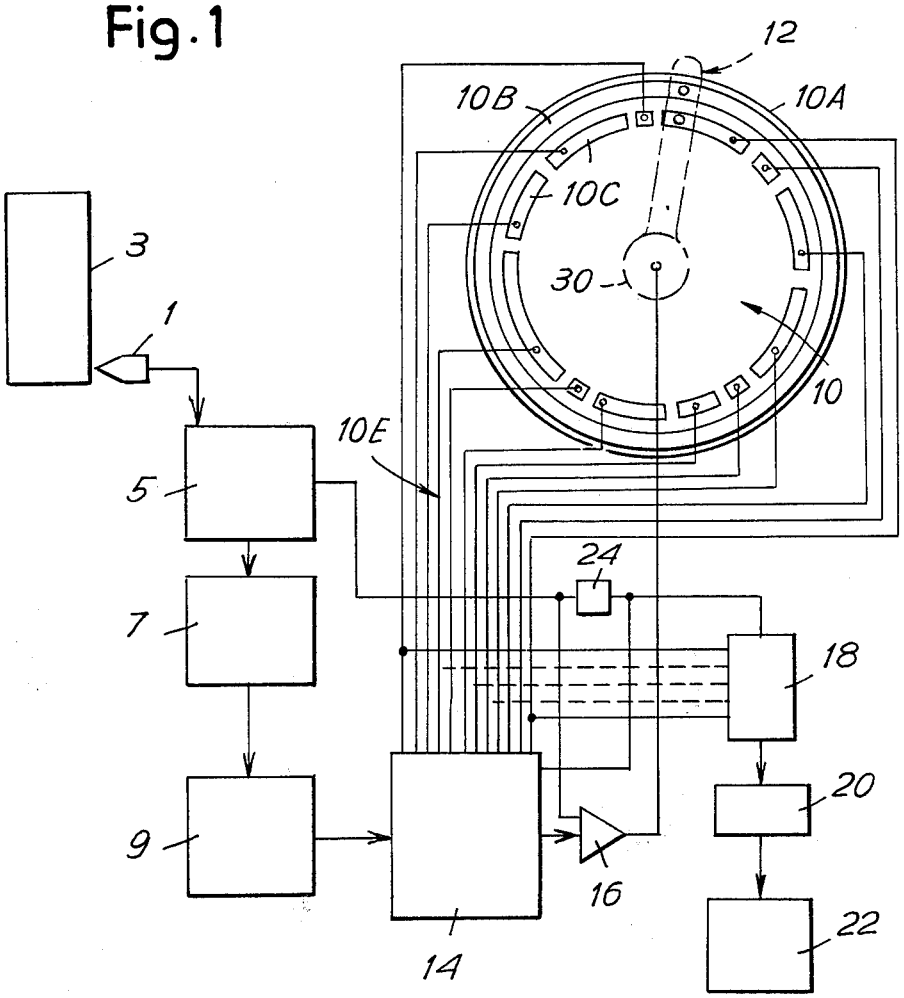
FIG. 1 illustrates a block diagram of the electrical system according to the present invention.

Schematically (see FIGS. 1 and 2) the electronic chain may be divided into the following components: a pulse generator 1 for generating a pulse signal in synchronization with the rotation of needle cylinder 3; a digital type electronic counter 5 which receives the signals from the pulse generator 1, and a decoding unit 7 for translating pulses from BCD to decimal; a cylinder revolution programming unit 9, which serves as a programmer of article types as well as sizes; a cam drum position indicating means including a programming disc 10 for generating signals responsive to the advances of the cam drum and brush means 12 angularly movable with the cam drum relative to the programming disc 10; a plurality of coincidence circuits 14, connected to the outputs of programmer 9 and programming disc 10; circuits 16 for controlling advances of the cam drum and as a result the advances of brushes 12; a speed programmer 18 for selecting the rotational speed of the needle cylinder 3 corresponding to selected stages of the cam drum; control circuits 20 responsive to the speed programmer for altering the speed of the motor 22 of the needle cylinder 3; and a zero setting unit 24 for counter 1.

In the pulse generator 1, an electronic circuit initiates a pulse signal, for instance, of + 15 volts at each cylinder revolution. The output of this circuit, normally at zero value (or nearly) in voltage, rises during a certain time interval (about a fiftieth of the time required by the cylinder to complete a revolution) to a prescribed value of + 15 volts. This function is obtained by means of conventional set-ups such as a magnetic sensor, proximity sensor, reed contact or the like, preferably without any mechanical contact.

The electronic counter 5 may be an electronic circuit which receives the signal coming from the pulse generator 1 of the cylinder and generates as an output, a state, that is, a group of voltage values on twelve lines which, according to the drawing, are in three groups 5A forming three decades (units, tens, hundreds). The aforesaid output is dependent upon the number of pulses or rotations received until that moment. The cylinder 3, in its rotation, by means of the pulse generator 1, forwards a pulse to the counter 5, which counts it and subsequently modifies the voltage value of zero or 15 volts D.C., for instance on each of its outputs 5B. By reading the voltage state of these output lines 5B of the counter 5, the number of the cylinder revolutions up to that moment is known. This number is given in binary form which, for facility of programming, is transformed into decimal form in decoding unit 7 from BCD to decimal, to easily program certain data by means of rotary switches, as hereafter described. In the unit decade of the decoder 7, the electronic circuits receive the information from the outputs 5B of the counter 5, that is, they read the state of its output lines under binary form, and transform the binary type information into decimal information. The decoder 7, for each decade 7A, has four inputs which come from the four respective outputs 5B of the counter 5 and ten outputs 7B. Each output is normally at 0 voltage and assumes a voltage value, for instance, of 15 volts only once for every ten pulses which arrive into the counter and remains at 15 volts until the next pulse has arrived. For instance, if at a determined moment, the output number "4" presents the value of 15 volts, this means that the counter has counted four pulses, that is, the cylinder has effected four complete rotations. The same is also available of course for the tens decade and hundreds decade which pulses are read and decoded on the other two units.

Figure 2:
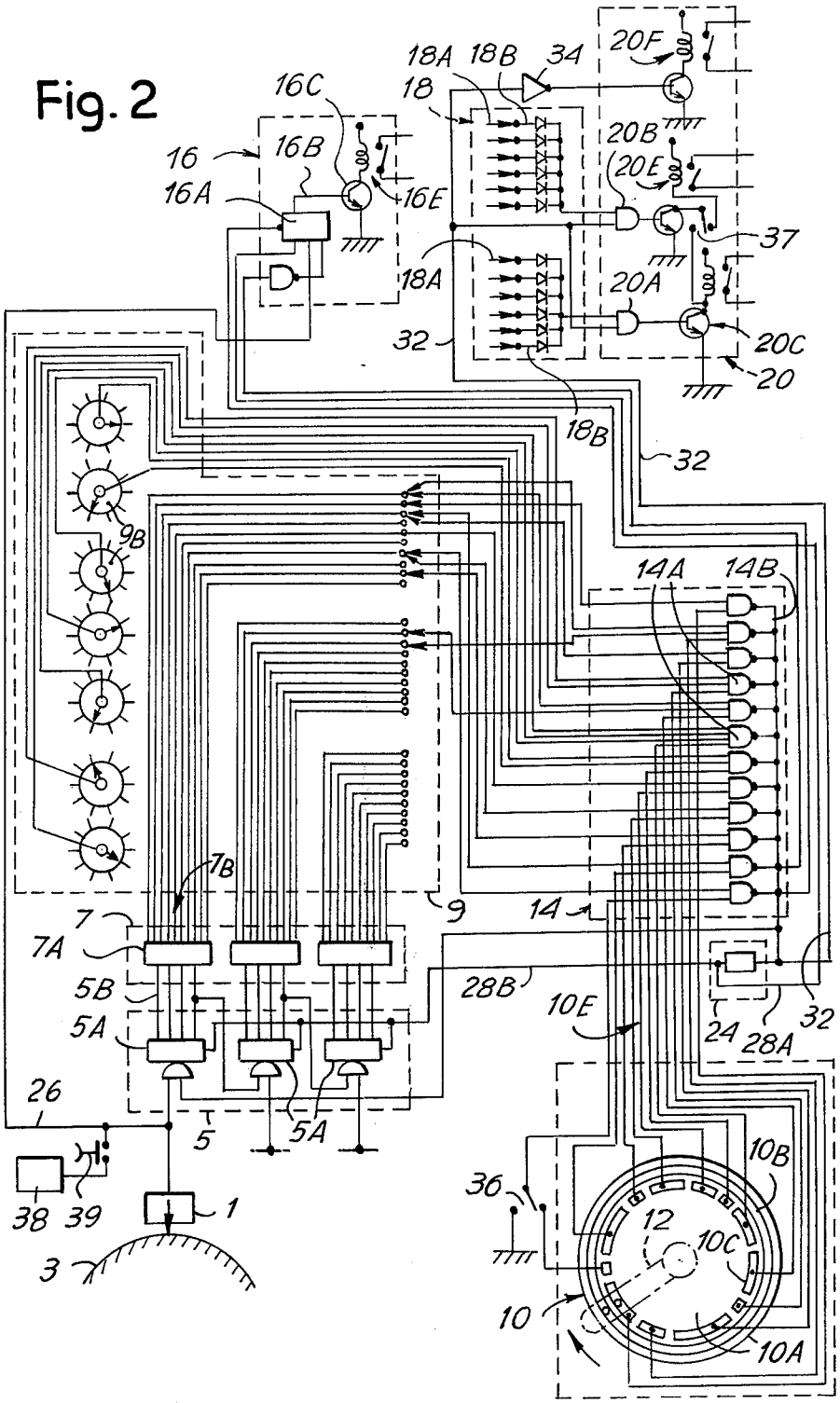
FIG. 2 is similar to FIG. 1, but illustrates a more detailed schematic diagram.

The programmer 9 of the article type and size being produced, is substantially a cylinder revolutions programmer. In this unit, connecting means are provided allowing an operator to impose as many revolutions of the cylinder as desired before starting the next movement of the cam drum, whereby a desired length of tubular article between two characteristic points may be formed with operations controlled by the cam drum. The outputs 7B of the decoding unit 7 extend from the three decades 7A which count in units, tens and hundreds (in the case shown up to 999 revolutions of the cylinder) and are connected to pin connectors 9A and to the contacts of rotary switches 9B (only exemplary connector wires being shown). As shown in FIG. 2, the rotary switches 9B are divided into three groups, indicated by brackets C, G and P, each of which is adapted to count the number of revolutions during the knitting of the various fabric areas of the garment, such as the panty, the legs, and the feet of a pantyhose. Group C includes switches C*u* of units and C*d* of tens; group G includes switches G*u* of units, G*d* of tens, and G*c* of hundreds; and group P includes switches P*u* of units and P*d* of tens. These rotary switches 9B provide manual control of the number of revolutions of the needle cylinder 3 during which the advance of the cam drum is controlled during the knitting of the various portions of the garment. Pin connectors 9A receive one end of some pins which have the other end thereof connected to the inputs of selected coincidence circuits 14 in such a manner as to count the desired number of pulses for each characteristic point. For instance, if between the end of the fourth movement of the cam drum and the start of the fifth movement, the cylinder must effect fourteen revolutions, two pins which come out of the coincidence circuits associated to that time period, that is the fifth, will be inserted, one into the connector number four of the units connector block and the other into the connector number one of the tens connector block.

The programming disc 10 is a disc 10A formed of insulating or non-conductive material, on which are located two concentric rings 10B and 10C of a conductive material. The ring 10B is continuous, while ring 10C has sectors being separated from one another and thus without electric continuity. The disc 10 is fixed, while wiping arm contacts 12A, which are electrically connected to each other, slide around the two rings 10B, 10C borne by the arm 12B which in turn is integrally connected to the cam drum and thus rotates therewith. In the continuous ring 10B, there is always impressed a fixed voltage, for instance 15 volts, while on the single sectors of the sector ring 10C, the applied voltage is zero. As contacts 12A are moved from segment to segment 10C, by means of arm 12, the 15 volt voltage is lead thereto, and said voltage remains on this segment or sector during the period while the drum is stopped and also for the entire time during movement when a contact 12A is located on the prescribed contact. The drum movement is terminated when the contact 12A leaves the conductive portion of the segment 10C, that is, when the voltage on that sector returns to zero, because the wiping or sliding contact 12A, in its movement with the drum, leaves the prescribed segment and intersects the subsequent segment. Therefore, the number of segments of the ring 10C correspond to the number of movements which the cam drum must effect to form a garment, such as a pantyhose, and the segments have an angular length corresponding to the number of movements or kicks required by the cam drum for knitting the various portions of the pantyhose. Each fixed segment 10C of the ring is connected to the assembly 14 of the coincidence circuits by means of one of electrical conductors 10E.

The coincidence circuits 14 are substantially formed by a plurality of NAND gates denoted by element number 14A, and inputs to the gates arrive as signals in the form of outputs from the programmer 9, and outputs 10E from the segments 10C of the program disc 10. The coincidence of the inputs are designed to program the drum advances. These gate-circuits also correspond in number to the number of segments 10C of the programming disc 10. The NAND circuit (as it is known) is a logic circuit which has, as an output, a zero voltage only when all its inputs are for instance at the level of 15 volts. On the other hand the output is at the level of 15 volts when the input from the segments 10C is at the level of 15 volts and when any one or more than one of its other inputs is at the zero level voltage. Thus, considering for instance, the operation of the NAND with relation to the fifth movement, one sees that only when the drum has accomplished the fourth movement and has remained in that position for the desired time (14 revolutions in the above example), the output assumes the value of zero voltage, a value which electrically permits the next movement of the drum. In fact the three inputs of this gate are at the 15 volts level only when the input coming from the fifth sector (which is normally at zero volts) is at 15 volts (when the sliding contact has reached the fifth sector), and the input coming from both of the other two inputs is at 15 volts (when the cylinder has accomplished 14 revolutions). The outputs 14B of the gates 14A are joined to one another for sending the signal on to the control group 16.

All the outputs 14B of the coincidence circuits arrive at the control circuits 16 which advance the cam drum. These signals, with zero voltage are received and transformed as a pulse which acts on a suitable mechanism (See FIGS. 4–9) designed to advance the drum by selectively connecting the shaft 30 of the cam drum mechanically with the cylinder 3 through an appropriate reduction mechanism to utilize and reduce the rotational speed of the needle cylinder. This pulse must be given only when the cylinder is located in a pre-established and precise position relative to its rotation. In other words, a reference or zero mark of the cylinder must be located in the instant of connection to the cam drum in front of a fixed pointer of the machine. The control circuit 16 includes a bistable device 16A which receives information from the coincidence circuits 14. Such information indicates that the revolution count has arrived at the predetermined figure for the prescribed segment with both a direct signal and a reversed signal by means of a logic inverter 16F. When the bistable device 16A receives the double signal, a signal is generated on one of its two outputs 16B, for instance a 15 volt voltage. This signal is only emitted when a synchronization signal, which has activated circuits 14, also arrives from line 26. The signal at the output 16B closes a switch which may be a transistor 16C, which in turn operates a relay 16E to activate a mechanical connecting member as described hereinafter, (for instance, a free wheel, an electromagnetic clutch, or directly an electromagnetic coupling or the like) which is directed into connecting relationship between the needle cylinder and the cam drum. The bistable device 16A remains in the signal received position, even if the signal in the meanwhile has been changed, until a zero setting signal arrives from line 28A at the bistable device from the unit 24. The same zero setting signal is transmitted through the line 28B at the end of the cam drum movement to clear the counter 5. The clearing is initiated when a signal from one of the gates of output 14B ceases as a result of contact 12A leaving the conductive portion of the segment previously contacted. The zero setting of the bistable device 16A causes disconnection of the mechanical connecting member between cylinder and drum and thus the cam drum is stopped.

Turning now to the speed programmer 18, one may observe the following. In the circular stocking machine, when the cam drum rotates, the array of the movable cams (latches or rods or the like) also moves, and the movable cams are brought into engagement with the needle or jack butts. These movements, besides being exact as to time, must also be made at a reduced speed of the cylinder in order to avoid violent impacts which could lead to consequent shearing of the needles or jack butts. For this purpose and as provided for in the present invention, while the cylinder is rotated at the maximum speed (depending on the knitting for the textile operation being performed) when the cam drum is stationary, it is rotated at a reduced speed during the time the cam drum is turning. There may also be provided a third speed, intermediate between the two aforesaid, during which time the cam drum is stationary but during which time it is necessary to operate the needle cylinder at a somewhat reduced speed.

In the speed programming unit 18, one may schedule the desired speed by inserting pins 18A into pin connectors 18B. Pins 18A are connected to another set of conductors leading from the segments of ring 10C of the program disc 10. Again the number of conductors is the same as the number of segments. The outputs from pin connectors 18B are connected to the circuits of the speed control unit 20. The pin connectors 18B and the pins 18A are divided in two groups, each group corresponding to either the intermediate or maximum speed depending on the operation being carried on during its corresponding segment 10C.

In speed control unit 20, the speed programming is controlled for each operation since the minimum speed is required when all the cam drum movements take place, in order to induce the minimum speed, it is sufficient to exploit or use the zero voltage leading from the coincidence circuits outputs. This zero voltage is carried through the line 32 to a logic switch or inverter 34, which transforms the zero voltage signal into a signal, for instance, of 15 volts, which is capable of closing the switch 20F to induce the minimum speed. Moreover, when the zero voltage signal is present in line 32 it serves to prevent the insertion of the other two speeds, as it is also supplied to both AND gates 20A and 20B.

One of the other two speeds may be inserted only when the drum is still, that is, when all the outputs of the coincidence circuits are at the 15 volts voltage and the associated signal arrives from the line 32 to the AND gates 20A and 20B. The two gates 20A and 20B form a logic AND circuit (that is a circuit which gives a 15 volts output only when all the inputs are at the 15 volts level) among all the outputs of the coincidence circuits (line 32) and any one of the segments 10C of the drum movement programming disc (through 18A and 18B) and one determines the speed to be kept in that point of the stocking, relating to a specific sector. Since there are two speeds (average and maximum), there are two AND circuits (indicated by 20A and 20B) which control with their outputs, first the switch 20C of the average speed and second the switch 20E of the maximum speed. All the outputs of the coincidence circuits and the lines coming from the segments 10C concerned with that speed are sent to the inputs of the two AND circuits. For instance, if the fourteen revolutions of the cylinder between the fourth and the fifth drum movement must be made at the maximum speed, the pin of the fifth sector will be arranged at the inputs of AND gate 20B, whose output controls the maximum speed.

The speed switching from maximum or average to minimum occurs with an advance of nearly one cylinder revolution. In fact, when from the unit 1 the *nth* pulse arrives, to which an advance of the cams drum must correspond, the action of the counter on the units 9, 10, 14 and also on the gates 20A and 20B of the unit 20, causing the speed reduction, is determined. But the *nth* pulse on the line 26 does not yet find the bistable device 16A conditioned by the coincidence circuits outputs 14, this being due to delays caused by the several inertias of the units 5, 7, 9 and also 14. Consequently only the $(n+1)^{th}$ pulse determines the generation of the signal by the bistable device 16A and thus the action of the switch or relay 16E or the like for the drum advancing. Therefore while the speed reducing begins on the $n^{th}$ pulse, the cam drum movement does not begin until the $(n+1)^{th}$ pulse.

Summarizing, the electronic counter 5, 7 counts the number of revolutions of the needle cylinder during the dwell periods of the cam drum, this corresponding to the period wherein the neutral loops in the conventional mechanical chain slide. When the counter reaches a pre-established value, previously imposed in the programmer 9 for that particular point of the stocking, a signal is generated from the coincidence circuits 14 to induce movement of the drum. A revolution before, by means of the line 32 and the members 20A, 20B, 34, a signal is generated to vary the motor speed, i.e. the machine, about a revolution before movement of the cam drum, is set at the speed at which the delivery has to be made, and on the subsequent revolution, the movement of the cam drum is made at the direction of control unit 16. This advance of the speed control is required because the motor does not instantaneously vary its speed and if the two controls, the speed variation control and the drum advance control, were simultaneous, one would have an excessive cylinder speed at the start of the cam drum movement. In the cam drum movement period (comparable to the high lugs of the conventional chain), the electronic counter remains locked or inactive, as the number of revolutions which the cylinder effects, is mechanically dependent on the length of the drum movement and thus this number of revolutions is known because it is set up previously and is obtained through the design of the length of segments 10C and the kinematic coupling between the cylinder and the drum. At the end of the delivery, the electronic counter is returned to zero by means of the zero setting unit 24, the new stage of the maximum or average speed begins, and a new count begins toward the new number of revolutions pre-set for that period. The interruptions between the segments 10C and the brushes 12A are pre-arranged to obtain the signal required at the unit 14 to cause the zero setting.

The equipment effects all the functions of the conventional chain, that is, it controls the drum deliveries, the motor speed variations, the beginning of the restriction zone, and the lengths of the several portions of the stocking, i.e. it functions and operates as a size-changer.

The system may be set to form a single stocking and stop the machine by positioning a switch 36 (see FIG. 2) of the chain operational mode on "Chain stop", or it may arranged for repetitive cycles by positioning the switch 36 on "normal".

Also the system is adaptable to form a stocking excluding the maximum speed, by providing a switch 37 under conditions of locating the control of 20B from the unit 20B to the unit 20C.

There is also provided an oscillator 38, connected by means of a pushbutton 39 to automatically return the machine to zero. The oscillator 38 when activated forwards pulses at a frequency much higher than that of the cylinder. With this operation, the machine is run at the minimum speed and accomplishes all the deliveries consecutively until the drum is brought back to zero. After reaching this point, the machine is automatically stopped even if the button 39 is still pressed. When the machine is returned to zero, in order to start a new cycle, it is sufficient to release the pushbutton 39, if the chain operational mode switch 36 is on "normal", or, if the switch 36 is on "stop", the machine begins again by moving this switch, or effecting the last cam drum movement manually.

Figure 3:
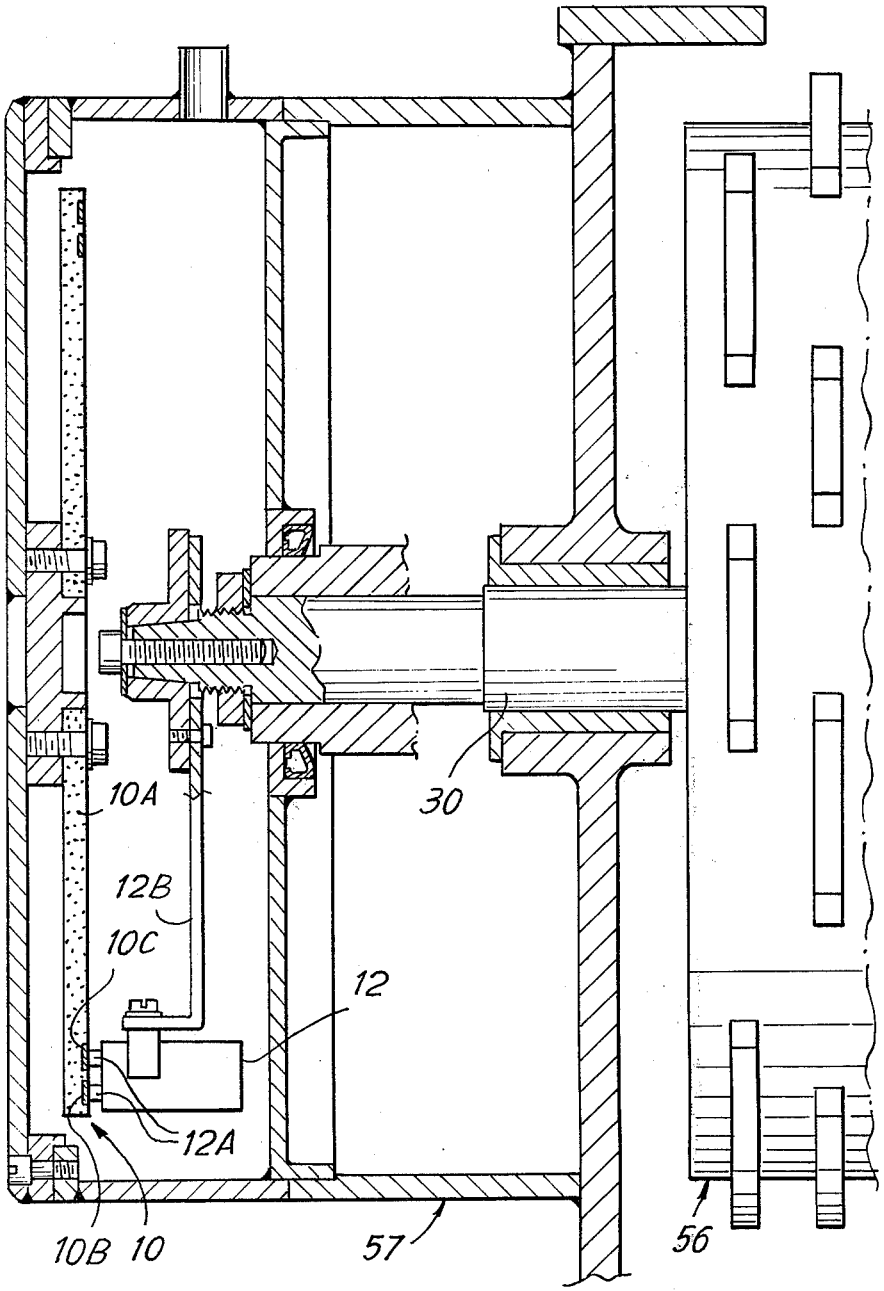
FIG. 3 illustrates in section a portion of the program cam drum, the brushes and the contact rings.
Figure 4:
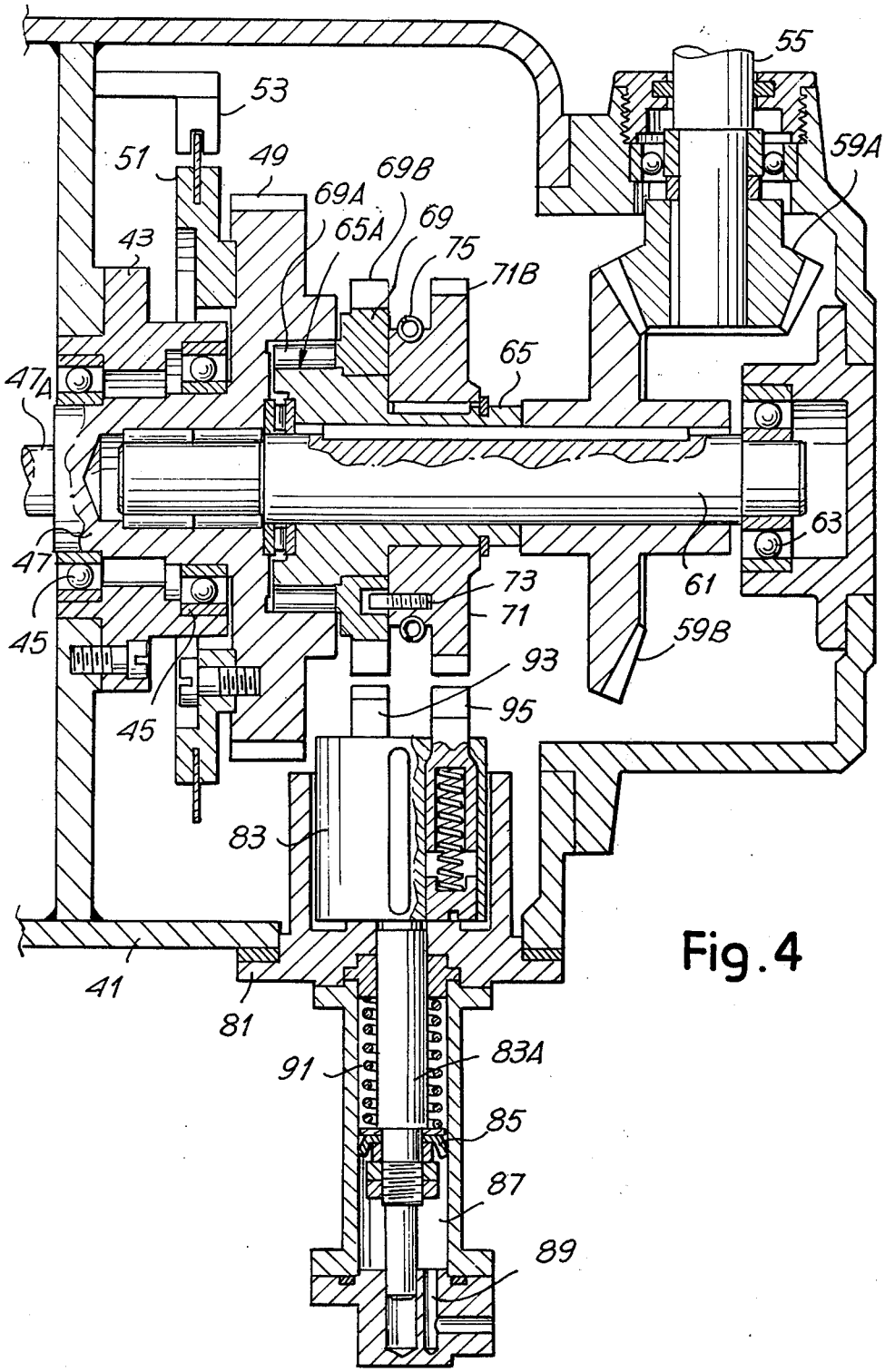
FIG. 4 illustrates a sectional view of one example of a coupling between the needle cylinder and cam drum.
Figure 6:
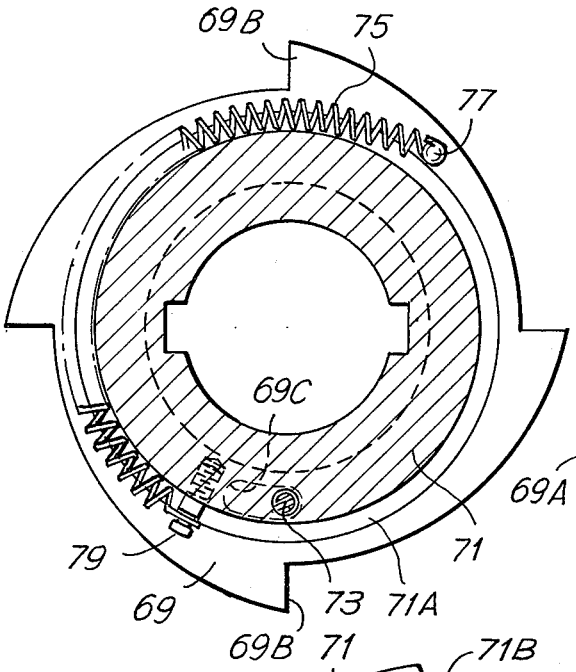

According to FIGS. 4 to 9, in a casing 41 of a stocking machine a support 43 is designed to support, by means of bearing 45, a rotary body 47, whose outer end 47A is connected to a drive mechanism (not shown) kinematically coupled to the needle cylinder motion. This drive may be direct or may include a reduction system to reduce the number of revolutions of body 47 per revolution of the cylinder. A gear 49 is integrally secured to rotary body 47 to provide a manual motion, for instance with a handwheel. An insulating disc 51 is also an integral part of rotary body 47 and includes suitable contacts designed to periodically operatively cooperate with a fixed contact 53. This arrangement represents a practical embodiment of the pulse generating unit indicated by 1 in the illustrations of FIGS. 1 and 2. The unit 51, 53 may operate by direct contact, by induction, by magnetic or capacitive effect or in any other suitable way. The rotary member 47 presents, at the end opposite outer end 47A, a cup-shaped recess forming a cylindrical surface 47B designed to form one of the two surfaces of a free wheel coupling to kinematically connect the needle cylinder to the program cam drum. A shaft 55 extending upwardly from casing 41 forms a drive shaft for the actuation of the cam drum 56 (see FIG. 3), to which drum (for instance through the shaft 30) the arm 12B is fixedly secured. The shaft 55 is coupled by means of a pair of gears 59A, 59B to a shaft 61 extending coaxial to the rotary member 47 and supported by a needle bearing in the interior of the member 47 on one side and by a bearing 63 on the other side.

A tubular body 65 is fixedly secured to shaft 61 and extends axially into the interior of the cup-shaped recess defined by the surface 47B of the body 47. The portion of said body 65, extending into said recess has an exterior periphery formed with six flat surfaces 65A joined by six cylindrical portions (FIG. 9). The surface 65A of the body 65 represents the other of the two surfaces of the free wheel coupling to kinematically connect the needle cylinder to the cam drum.

Rollers 67 are interposed between the surfaces 47B and 65A through which the coupling and release of shafts 61, 55 are respectively effected. The rollers 67 are retained by a cage formed by arms 69A extending axially from an annular member 69. Member 69 is attached to but movable angularly with respect to the body 65 and is provided with a series of peripheral teeth 69B with a radial side and a continuous profile between the teeth. A second annular member 71 is the body 65, and fixedly secured to the rear of said member is adjacent the front annular member 69 and has a pin 73 designed to penetrate into an arcuately elongated slot 69C in the front opposite surface of the annular member 69. In this way, it is possible to have a restricted angular movement of the cage and roller assembly or roller cage 69 with respect to the unit 71, 65, 61, which in turn form the driven member of the free wheel coupling and thus drive the cam drum 56. The member 71 additionally presents an annular race 71A, in which a helical spring 75 is partly accomodated. One of the ends of said spring is fixed to a pin 77 of the annular member 69 of the roller cage 69 while the opposite end of said spring 75 is fixed to a pin 79 extending outwardly in a radial direction from the race 71A of the member 71. The arrangement of the spring 75, the pin 73, and the elongated slot 69C are such that the spring 75 tends to move the roller cage in the direction which causes the wedging of the rollers 67 between the surfaces 47B and 65A. At the same time and as a result pin 71 bears against the bottom of the elongated slot 69C (with a relative movement of the members 69 and 71 in a direction opposite the one to which they are angularly urged by the sping 75), to position the rollers 67 in an intermediate position of the flats of the outer surface 65A of the driven member 65, the free wheel coupling being thus unlocked.

The member 71 is further provided with an outer profile having recesses 71B which correspond in number, and approximately in position, to the radial sides of the teeth 69B of the member 69 of the rollers cage.

A support 81 is accommodated in the casing 41 and provides a radial guide (with respect to the axis of the members 47, 61) for a locking unit comprising a head 83 and a stem 83A, the latter carrying a packing 85 like a slidable piston in a cylindrical seat 87, to constitute a cylinder-piston system. When said cylinder is fed by compressed air from the input 89, the unit 83, 83A is radially urged towards the axis of the members 47, 61, while under the discharge conditions from the cylinder, a spring 91 radially returns said unit 83, 83A in the centripetal direction (downwards looking in the drawing). The head 83 has a stop 93 designed to cooperatively engage the radial shoulders of the teeth 69B in such a manner as to retain in a prescribed position the cage 69, 69A of the rollers 67. The head 83 also has a resilient latch 95, slidable in the head 83 and urged by a small spring 97 in such a manner as to project in the centripetal direction from the head 83 towards the outer profile of the member 71. Extended latch 95 cooperates with the banks of the recesses 71B. The recesses 71B and correspondingly the active end of the latch 95 are wedge-shaped in such a manner as to assure the centering of the member 71 as well as to assure the stopping thereof. For this purpose the bank or side of each of the recesses 71B, which is rear with respect to the rotational motion direction indicated by the arrows *f*1, is higher than the front bank or side, both to form a positive stop for the latch 95 and to allow an eventual settling of the member 71 with a slight return movement with respect to the advance rotational direction.

During the operational stages of the machine, when the needle cylinder must rotate but not the cam drum, that is when and until the drive 65, 61, 55 must be unlocked with respect to the drive member 47, 47A, the unit 83, 83A is inserted to act on the teeth 69B and on the recesses 71B, in the manner shown in FIG. 9. Under these conditions, the kinematic chain formed by the members 65 (65A), 61, 59A, 59B, 55 is locked in a predetermined angular position. The stop 93 retains the annular member 69 of the rollers cage 69A in a pre-established position with respect to the member 71, wherein the rollers 67 are positioned approximately at the center of the peripheral flats 65A of the member 65, the member 69 pressing a side 69B on the stop 93 by effect of the spring 75. In order to obtain and maintain these conditions, air pressure is supplied to the ingress 89 for the centripetal advance of the head 83.

Upon a signal from a control pulse, coming in this particular case from the unit 16 to advance the drum, air is discharged from the cavity of the cylinder 87 and the spring 91 moves unit 83, 83A in the centrifugal direction. This causes the release of the members 69 and 71 from the unit 83, 83A and the immediate coupling of the members 47 and 65 by effect of the return of the spring 75 in the same direction of the arrow *f1* indicating the rotation of the drive member 47, 47A. This in turn causes the wedging of the rollers 67 between the drive surface 47B and the driven surface 65A.

In order to interrupt the entraining of the output shaft 55 (that is of the cam drum), the unit 83, 83A is advanced again in the centripetal direction, whereby the stop 93 presses on the teeth of the member 69 and by cooperating with the side 69B locks the cage 69, 69A. By the centripetal advance of the unit 83, the latch 95 also contacts the outer profile of the member 71, said latch returning elastically until it is wedged in one of the recesses 71B. This also stops the inertia motion of the driven portion of the free wheel coupling. The higher bank of the recess 71B and the wedge contour of latch 95 serve to return the member 71, should the latter be slightly advanced. The motion of the unit 83, 83A for the locking of the members 69 and 71 also causes the restricted reloading of the spring 75 for the extent this spring has been unloaded for the rollers wedging. The rollers return into the intermediate position of the flats 65A.

It is intended that the drawing only illustrates an embodiment given only as a practical demonstration of the invention, said invention being in conditions as to be varied in the forms and arrangements without however departing from the scope of the concept which informs the same invention.

I claim:

1. A control system for circular stocking machines and the like of the type including a needle cylinder, a programming cam drum, and control means to modify the cylinder speed between a minimum and a maximum rate, said system including:

a. a counting means for counting needle cylinder revolutions and generating pulses responsive to a prescribed number of revolutions, said counting means including a zero setting means;

b. a programming unit receiving the pulses from said counting means and including programming means for transmitting output signals responsive to a prescribed number of pulses from said counter;

c. a rotating member integrally connected with said programming cam drum and including electrical contact means, and a fixed member including a plurality of conductive arcuate segments successively engageable by said electrical contact means of said rotating member, said arcuate segments having output lines operatively connected to said programming unit to indicate drum position to said programming unit, said segments corresponding in length to the relative length of movements of said cam drum between successive positions; and d. an assembly of coincidence circuits, receiving the output signals from said programming unit and receiving the output signals from said arcuate segments, said coincidence circuits causing an output signal after a programmed number of revolutions for each stopping position of said cam drum have occurred, so as to initiate the advance of said cam drum and said rotating member.

2. A control system according to claim 1, including a control unit for advancing said cam drum and wherein said coincidence circuits assembly includes a plurality of NAND logic gates with a first group of inputs connected to said arcuate segments and a second group of inputs connected to said programming unit output signals; the outputs of said NAND gates being operable to supply signals to said control unit for the cam drum advance, to said zero setting means, and to said needle cylinder speed control means.

3. A control system according to claim 1, wherein said counting means includes revolution counters of the binary form, said counting means further including a decoding means for translating binary signals into decimal signals, wherein said programming means of said programming unit includes rotary switch contacts, and wherein said rotary switch contacts are operable to modify the dimensions of the article.

4. A control system according to claim 1, and further including a speed control unit having electronic control means for initiating minimum speed and a locking gate means for initiating a higher speed, said electronic control means and said locking gate means being selectively activated responsive to signals from said coincidence circuits, and said electronic control means including a signal logic inverter which is operated by the annulling of a voltage.

5. A control system according to claim 4 including means to move said needle cylinder with at least two speeds higher than the minimum one, wherein said locking gate means includes two locking AND gate means, each AND gate means operatively controlling one of said two higher speeds, and each of said AND gate means receiving selectively a signal from said coincidence circuit and a signal from selected ones of said arcuate segments of the contact means of said fixed member, whereupon the system is operated at either a maximum speed responsive to some preselected drum positions or an intermediate speed responsive to other drum positions or at the minimum speed during the advance of said cam drum.

6. A control system according to claim 5, including a unit for controlling the advance of said cam drum, said unit including a bistable switch which generates a control signal when it receives both a signal from said coincidence circuits and also a synchronization pulse from said revolution counters, said zero setting means providing a signal to cease the drum advance in response to the movement of said rotating member into a non-conductive space between two of said arcuate segments, the inertia of said counter members, of said programming unit, of said coincidence circuits and of said bistable device being such that the synchronization pulse, which initiates the drum advance, is subsequent to the output signal from said coincidence circuits which reduces the needle cylinder to the minimum speed.

7. A control system according to claim 1 wherein said electrical contact means on said rotating member includes a double brush wiping contact, and wherein said fixed member includes an endless annular metal track bearing voltage, said double brush wiping contact including one brush which contacts said endless track and a second brush which contacts said arcuate segments so that an electrical connection is formed between said endless track and successive ones of said arcuate segments.

8. A control system according to claim 1 wherein said counting means includes a rotating member rotating in timed relationship with said needle cylinder, a contact carried by said rotating member, and a sensor supported adjacent said rotating member for transmitting an output signal upon passage of said contact carried by said rotating member.

9. A control system for circular stocking machines of the type including a needle cylinder, a programming cam drum, and speed control means to adjust the cylinder speed, said system including a. counting means operatively cooperating with said cylinder to count the rotations thereof and generate electrical pulses responsive thereto;

b. program means responsive to a prescribed number of pulses from said counting means for generating output signals, said program means being selectively variable to be responsive to a selected number of pulses from said counting means to generate output signals;

c. cam drum position indicating means for generating output signals responsive to said prescribed drum positions;

d. electronic gate means receiving output signals from said cam drum position indicating means and said program means and delivering output signals responsive to prescribed conditions;

e. cam drum control means receiving signals from said gate means and initiating the advance of said cam drum; and f. electronic speed programming means operatively connected to said speed control means for reducing said cylinder speed to a minimum during the advance of said cam drum.

10. A control system according to claim 9 wherein said electronic speed programming means of said speed control means is operatively connected to said cam drum position indicating means and includes first and second circuits, said first circuit being connected to some of said output signals generated by said cam drum positioning means and said second circuit being connected to other of said output signals generated by said cam drum positioning means, wherey said needle cylinder is run at one speed during certain selected drum positions and at another speed during other selected drum positions.

11. The control system according to claim 9 wherein said cylinder rotation counting means includes a pulse generator which generates an electrical pulse for each rotation, a counter which counts and stores the pulses as binary data, and a decoder which translates the binary data into decimal data and delivers it to said program means.

12. The control system according to claim 9 wherein said program means includes pin connectors and rotary switches selectively connected to said electronic gate means.

13. The control system according to claim 9 wherein said electronic gate means include a plurality of NAND logic gates, the number of gates corresponding to the number of drum positions, each logic gate being operable to transmit a signal to said cam drum control means upon receipt of a first signal from said cam drum position indicating means that the drum is in the position corresponding to the selected gate and a second signal from said program means that the cylinder has completed a prescribed number of revolutions.

14. The control system according to claim 13 wherein said cam drum position indicating means comprises a stationary disc formed of a non-conductive material having two concentric annular tracks of conductive material secured thereto, one of said annular tracks being continuous and the other segmented, said segmented track comprising a plurality of arcuate segments having spaces therebetween, each arcuate segment being connected to one of said logic gates and said continuous track having a voltage impressed thereon, and a rotary arm rotated synchronously with said cam drum, said rotary arm including a pair of brush members electrically connected to each other, one of said brush members engaging said continuous annular track during rotation of said rotary arm and the other brush member sequentially engaging said arcuate segments during rotation of said rotary arm, whereby as said rotary arm rotates said voltage is transferred from said continuous annular track to successive ones of said arcuate segments with a period of no voltage transfer between arcuate segments, said transferred voltage being passed on to the corresponding NAND gate to indicate drum position.

* * * * *